US011135133B2

(12) United States Patent
Kim

(10) Patent No.: US 11,135,133 B2
(45) Date of Patent: Oct. 5, 2021

(54) MEDICINE CASSETTE AND AUTOMATIC MEDICINE PACKING MACHINE THEREWITH

(71) Applicant: JVM CO., LTD, Daegu (KR)

(72) Inventor: Jun-ho Kim, Daegu (KR)

(73) Assignee: JVM CO., LTD, Daegu (KR)

( * ) Notice: Subject to any disclaimer, the term of this patent is extended or adjusted under 35 U.S.C. 154(b) by 0 days.

(21) Appl. No.: 16/131,834

(22) Filed: Sep. 14, 2018

(65) Prior Publication Data

US 2019/0091106 A1 Mar. 28, 2019

(30) Foreign Application Priority Data

Sep. 26, 2017 (KR) ..... 10-2017-0124552

(51) Int. Cl.
*A61J 7/00* (2006.01)
*B65B 5/10* (2006.01)
(Continued)

(52) U.S. Cl.
CPC ..... *A61J 7/0076* (2013.01); *A61J 7/0084* (2013.01); *A61J 7/02* (2013.01); *B65B 5/103* (2013.01);
(Continued)

(58) Field of Classification Search
CPC ..... A61J 7/0076; A61J 7/0084; A61J 7/0454; A61J 7/0463; B65B 35/06; B65B 35/08;
(Continued)

(56) References Cited

U.S. PATENT DOCUMENTS 4,091,600 A * 5/1978 Itoh ..... A61J 3/074 198/396
6,471,093 B1 * 10/2002 Kodama ..... B65G 47/1457 221/266
(Continued)

FOREIGN PATENT DOCUMENTS

JP 2000097865 A 4/2000
JP 2004-041432 A 2/2004
(Continued)

*Primary Examiner* — Gene O Crawford
*Assistant Examiner* — Kelvin L Randall, Jr.
(74) *Attorney, Agent, or Firm* — Dinsmore & Shohl LLP; Yongsok Choi, Esq.

(57) ABSTRACT

A medicine cassette includes a medicine supplier configured to supply accommodated medicines according to prescription information, a medicine delivery part configured to deliver the medicines supplied from the medicine supplier to a medicine discharge part, and the medicine discharge part configured to discharge the medicines, which are delivered through the medicine delivery part, to the outside. The medicine supplier may include a medicine accommodation part configured to accommodate the medicines and a rotating rotor part configured to deliver the medicines accommodated in the medicine accommodation part to the medicine delivery part. The rotating rotor part may include a rotating rotor, and at least one sliding member. The sliding member may be configured to be outwardly moved in the radial direction of the rotating rotor as the recess of the rotating rotor approaches a medicine supply inlet configured to supply the medicines to the medicine delivery part.

9 Claims, 12 Drawing Sheets

(51) Int. Cl.

| | |
|---|---|
| ***A61J 7/02*** | (2006.01) |
| ***G07F 11/16*** | (2006.01) |
| ***B65B 35/08*** | (2006.01) |
| *G07F 11/42* | (2006.01) |
| *B65B 9/06* | (2012.01) |

(52) U.S. Cl.
CPC ..... *B65B 35/08* (2013.01); *G07F 11/165* (2013.01); *B65B 9/06* (2013.01); *G07F 11/42* (2013.01)

(58) Field of Classification Search
CPC .... B65B 57/20; B65D 83/0083; B65D 83/04; B65D 2583/0481; G07F 11/005; G07F 11/24; G07F 11/0092
See application file for complete search history.

(56) References Cited

U.S. PATENT DOCUMENTS 6,651,842 B2 * 11/2003 Collins ..... B07C 3/082 198/445
6,799,684 B2 * 10/2004 Wooldridge ..... B07C 5/38 209/551
2002/0113076 A1 * 8/2002 Collins ..... B07C 3/082 221/76
2006/0058724 A1 3/2006 Handfield et al.
2011/0088810 A1 * 4/2011 Cicognani ..... B65B 5/08 141/192
2014/0014678 A1 * 1/2014 Yuyama ..... G07F 11/44 221/277
2014/0231446 A1 * 8/2014 Kim ..... B65B 5/103 221/1
2016/0167866 A1 6/2016 Omura
2018/0028407 A1 * 2/2018 Omura ..... A61J 7/0076

FOREIGN PATENT DOCUMENTS

| | | | | |
|---|---|---|---|---|
| JP | 2004041432 | A | * | 2/2004 |
| JP | 4261662 | B2 | | 2/2009 |
| JP | 2012254830 | A | | 12/2012 |
| JP | 2015-202885 | A | | 11/2015 |
| JP | 2015202885 | A | * | 11/2015 |
| KR | 10-0729477 | B1 | | 6/2007 |
| KR | 10-1356965 | B1 | | 1/2014 |
| WO | 0194205 | A1 | | 12/2001 |

* cited by examiner

100

MEDICINE CASSETTE AND AUTOMATIC MEDICINE PACKING MACHINE THEREWITH

CROSS-REFERENCE TO RELATED APPLICATION

This application claims priority to and the benefit of Korean Patent Application No. 10-2017-0124552, filed on Sep. 26, 2017, the disclosure of which is incorporated herein by reference in its entirety.

TECHNICAL FIELD

The present disclosure relates to a medicine cassette configured to automatically discharge medicines according to prescription information and an automatic medicine packaging apparatus including the medicine cassette, and more particularly, to a medicine cassette configured to automatically discharge shaped medicines as well as shapeless medicines such as half-tablets and the like according to prescription information and an automatic medicine packaging apparatus including the medicine cassette.

BACKGROUND ART

There has been developed and used an automatic medicine packaging apparatus which receives medicines from a plurality of cassette devices, in which the medicines such as tablets and capsules are accommodated according to types thereof, and continuously packages a dose of medicines.

As shown in FIG. 1, the automatic medicine packaging apparatus includes a main body 10, a plurality of medicine cassettes 20 provided at an upper portion of the main body 10 and configured to accommodate medicines of various sizes and shapes (e.g., tablets, capsules, and the like), a hopper 30 provided at a lower portion of the main body 10 and configured to collect medicines dropped from the plurality of medicine cassettes 20, a printing device 40 configured to print various information on a surface of a wrapping paper for packaging the medicines, and a packaging device 50 configured to package the medicines, which are collected by the hopper, with the wrapping paper.

Meanwhile, the medicine cassettes 20 provided at the automatic medicine packaging apparatus includes a cassette main body configured to accommodate medicines of various sizes and shapes, a distribution block rotatably provided at the cassette main body and configured to discharge the medicines, and a partition member installed at the cassette main body and configured to discharge the medicines, which are discharged from the distribution block, at a predetermined amount, and thus discharges the medicines, which are accommodated in a cassette device through a discharge recess formed in the distribution block to the outside.

However, the medicine cassette provided at a conventional automatic medicine packaging apparatus is generally configured to discharge only medicines having a predetermined shape and size corresponding to a discharge recess formed at a distribution block, and thus when a variant medicine of which form is shapeless (e.g., a half-tablet obtained by halving a medicine, etc.) is included in the medicine cassette, there is a problem in that medicines cannot be automatically discharged according to a prescription information.

In order to resolve such a problem, a medicine cassette capable of being configured to discharge variant medicines such as half-tablets and the like has recently emerged. For example, Korean Patent No. 10-0729477 (Prior Art 1) discloses a medicine cassette (a tablet feeder) configured to automatically supply half-tablets.

As shown in FIGS. 2 and 3, the medicine cassette disclosed in Prior Art 1 operates to rotate a rotor 70 provided at a lower portion of a supplier vessel 60, thereby discharging tablets accommodated in the supplier vessel 60 through a supply inlet. In particular, the medicine cassette disclosed in Prior Art 1 is configured such that a bottom surface of the supplier vessel 60 is installed to be inclined toward the supply inlet and the disc-shaped rotor 70 is disposed on the inclined bottom surface, and a substantially U-shaped notch portion 75 is provided at an outer circumferential surface of the disc-shaped rotor 70 so that a half-tablet medicine is moved to the supply inlet to be discharged in a state of being inserted into the notch portion 75, as shown in FIG. 2.

However, such a medicine cassette has a problem that it is difficult to smoothly discharge half-tablet medicines since the medicine cassette is configured to discharge only half-tablet medicines having a shape and a size, which correspond to those of the notch portion 75 formed at the rotor 70, and discharge half-tablet medicines only in a state of being arranged in the notch portion 75 in a correct direction. Particularly, the above-described conventional medicine cassette is configured such that half-tablet medicines can be discharged to the outside through gravity only when the half-tablet medicine is inserted into the notch portion 75 in a state that a bottom surface of the half-tablet medicine is brought into contact with the bottom surface of the supplier vessel 60 as a medicine indicated by a reference numeral "a" in FIG. 3, or only when the half-tablet medicine is inserted into the notch portion 75 in a state that a straight portion of the half-tablet medicine is positioned at an outer circumference of the notch portion 75 as a medicine indicated by a reference numeral "b" in FIG. 3, and thus there is a problem in that half-tablet medicines cannot be smoothly discharged.

SUMMARY

The present disclosure is directed to a medicine cassette configured to rapidly, accurately, and automatically discharge shaped medicines as well as shapeless medicines such as half-tablets and the like according to prescription information, and an automatic medicine packaging apparatus including the medicine cassette.

A representative configuration of the present disclosure for achieving the above-described objectives is as follows.

According to one embodiment of the present disclosure, there is provided a medicine cassette for automatically supplying medicines according to prescription information. The medicine cassette according to one embodiment may include a medicine supplier configured to supply accommodated medicines according to prescription information, a medicine delivery part configured to deliver the medicines supplied from the medicine supplier to a medicine discharge part, and the medicine discharge part configured to discharge the medicines, which are delivered through the medicine delivery part, to the outside. The medicine supplier may include a medicine accommodation part configured to accommodate the medicines and a rotating rotor part configured to deliver the medicines accommodated in the medicine accommodation part to the medicine delivery part. The rotating rotor part may include a rotating rotor, which is formed in a disc shape and has at least one recess formed at an outer circumference of the rotating rotor part, and at least one sliding member which is installed at the recess of the rotating rotor such that the sliding member is movable in the recess of the rotating rotor along the radial direction of the rotating rotor. The sliding member may be configured to be outwardly moved in the radial direction of the rotating rotor as the recess of the rotating rotor approaches a medicine supply inlet configured to supply the medicines to the medicine delivery part.

A protrusion vertically extending from the sliding member may be provided at a rear surface of the sliding member, and the protrusion may be inserted into and installed at a guide groove formed at a base portion of the medicine accommodation part at which the rotating rotor is installed. The guide groove formed at the base portion may be formed in a structure of guiding a movement of the sliding member to be outwardly moved in the radial direction of the rotating rotor as the recess of the rotating rotor approaches the medicine supply inlet.

The guide groove formed at the base portion may be formed in a structure of guiding a movement of the sliding member to be inwardly moved in the radial direction of the rotating rotor after the recess of the rotating rotor passes the medicine supply inlet.

The sliding member may have a structure in which a surface of the sliding member, which is located at an outer circumference of the rotating rotor when the sliding member is stalled at the rotating rotor, is downwardly inclined from a front side of a rotational direction of the rotating rotor to a rear side thereof.

The medicine accommodation part may have a space extension configured to secure empty space in the vicinity of the recess which is ascended toward the medicine supply inlet.

The medicine delivery part may include a transfer part having an upper portion on which the medicines are disposed and a vibration part configured to apply vibration to the transfer part, and the medicines disposed on the transfer part may be transferred one by one to the medicine discharge part due to vibration applied by the transfer part.

The medicine discharge part may include a detector installed at an inlet through which the medicines transferred from the medicine delivery part pass and configured to detect the number of medicines which pass the inlet, a retention member on which the medicines passing the detector is temporarily retained, and an opening and closing member installed at a downstream side of the retention member and configured to move the medicines toward a packaging passage or a recollecting passage according to a detection result of the detector, and the opening and closing member may be pivotably installed between the packaging passage and the recollecting passage, and when the number of the medicines detected by the detecting means matches the prescription information, the opening and closing member may be operated to open the packaging passage while closing the recollecting passage, whereas when the number of the medicines detected by the detector does not match the prescription information, the opening and closing member may be operated to open the recovery passage and, simultaneously, close the packaging passage.

The retention member and the opening and closing member may be configured to be pivotable within a predetermined angle range by a drive motor.

According to an embodiment of the present disclosure, there is provided a medicine cassette for automatically supplying medicines according to prescription information. The medicine cassette may include a medicine supplier configured to supply accommodated medicines according to prescription information, a medicine delivery part configured to deliver the medicines supplied by the medicine supplier to a medicine discharge part, and the medicine discharge part configured to discharge the medicines, which are delivered through the medicine delivery part, to the outside. The medicine supplier may include a medicine accommodation part configured to accommodate the medicines and a rotating rotor part configured to deliver the medicines accommodated in the medicine accommodation part to the medicine delivery part. The rotating rotor part may include a rotating rotor, which is formed in a disc shape and has at least one recess formed at an outer circumference of the rotating rotor part, and at least one sliding member which is installed at the recess of the rotating rotor such that the sliding member is movable in the recess of the rotating rotor along the radial direction of the rotating rotor. The sliding member is operated to close the recess of the rotating rotor when the recess of the rotating rotor reaches the medicine supply inlet configured to supply the medicines to the medicine delivery part.

According to one embodiment of the present disclosure, there is provided an automatic medicine packaging apparatus including the above-described medicine cassette.

In addition, the medicine cassette according to the present disclosure and the automatic medicine packaging apparatus including the medicine cassette may further include other additional configurations without departing from the technical spirit of the present disclosure.

In accordance with the medicine cassette according to one embodiment of the present disclosure, a rotating rotor part is configured with a rotating rotor having recesses into which medicines are inserted at an outer circumference and a sliding member movably installed along a radial direction of the rotating rotor. Accordingly, the medicines are inserted into the recess of the rotating rotor and moved toward a medicine supply inlet, and then are pushed out to the outside of the recess through a sliding member. As a result, the medicines can be smoothly supplied to the outside. Particularly, the medicine cassette according to one embodiment of the present disclosure can more rapidly supply the medicines since medicines can be supplied to the outside of a medicine supplier regardless of shapes of the medicines or directions of the medicines inserted into the recess.

Further, the medicine cassette according to one embodiment of the present disclosure is configured to transfer the medicines supplied from the medicine supplier to a medicine discharge part through a medicine delivery part including a transfer part at which the medicines are disposed and a vibration part configured to apply vibration to the transfer part such that the medicines can be delivered one by one to the medicine discharge part in a state of not being bundled. Accordingly, only a required number of the medicines can be accurately supplied according to prescription information in the medicine cassette according to one embodiment of the present disclosure.

DETAILED DESCRIPTION OF EXEMPLARY EMBODIMENTS

Figure 1:
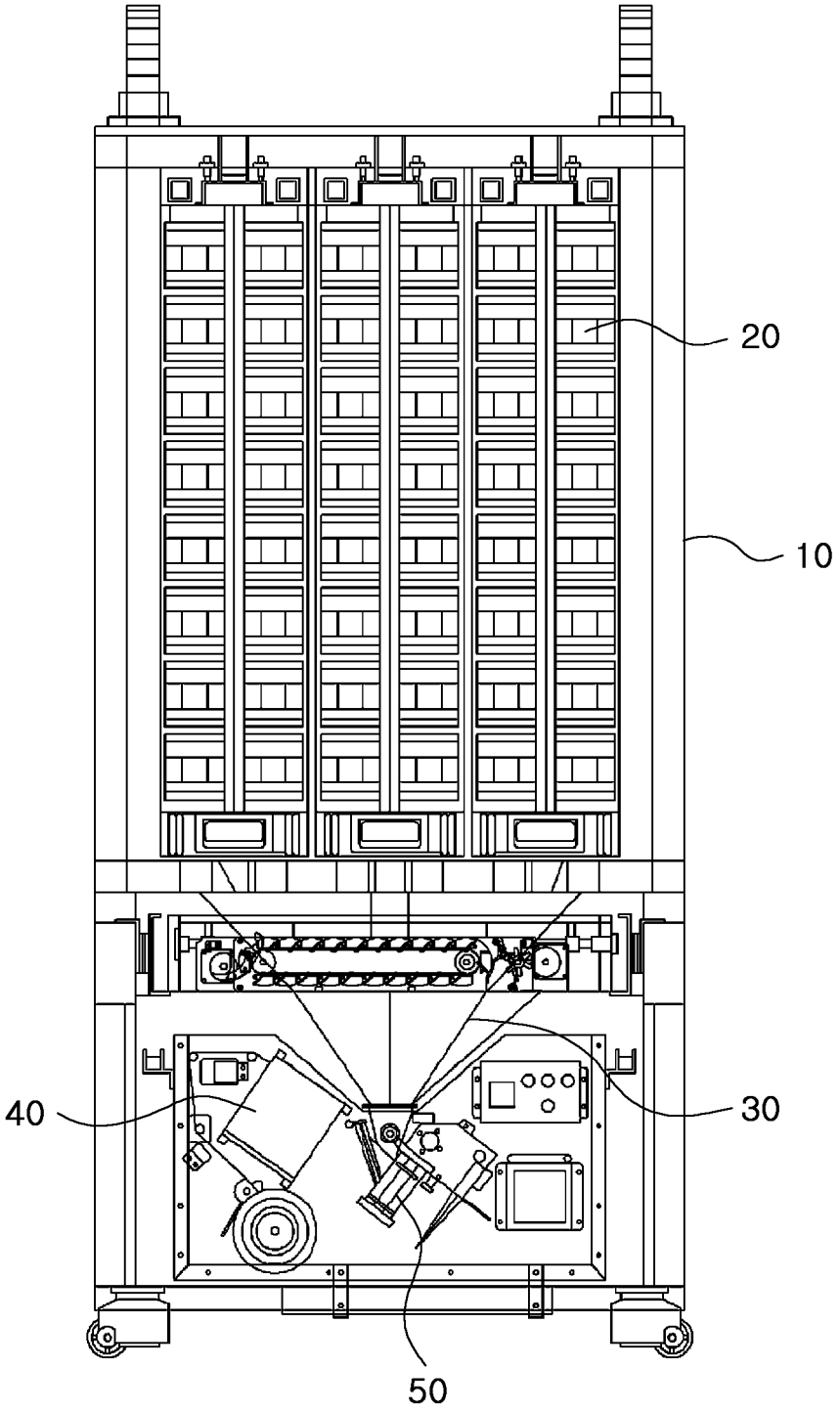
FIG. 1 exemplarily illustrates a schematic structure of an automatic medicine packaging apparatus.
Figure 2:
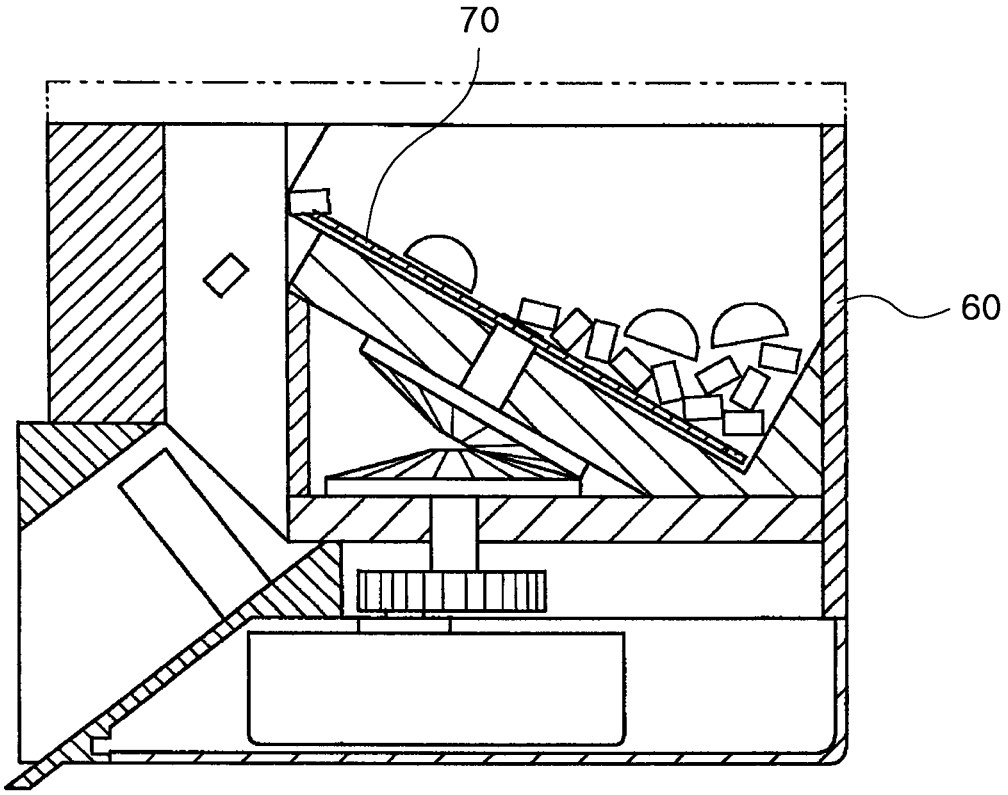
FIG. 2 exemplarily illustrates a structure of a conventional medicine cassette (a tablet feeder) used in the automatic medicine packaging apparatus.
Figure 3:
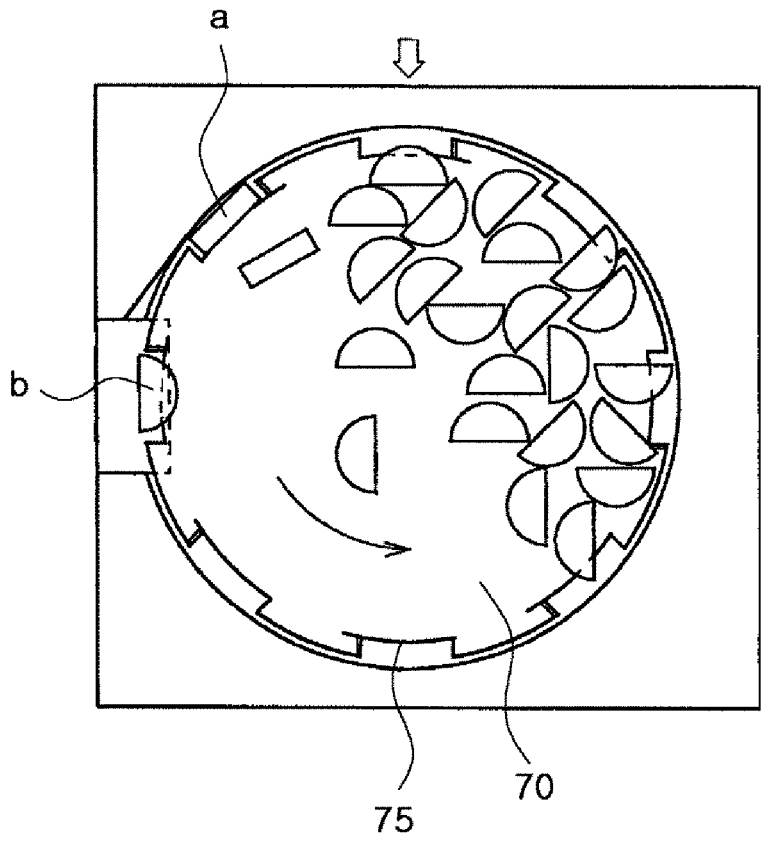
FIG. 3 exemplarily illustrates a structure of a rotor in the medicine cassette (the tablet feeder) shown in FIG. 2.

Hereinafter, exemplarily embodiments of the present disclosure will be described in detail with reference to the accompanying drawings so that those skilled in the art to which the present disclosure pertains may easily carry out the present disclosure.

In order to clearly describe the present disclosure, a detailed description on parts which are not related to the present disclosure will be omitted, and the same components will be described by the same reference numerals throughout the specification. In addition, since a shape and size of each component shown in the drawings are arbitrarily shown for convenience of explanation, the present disclosure is not necessarily limited to the illustrated shape and size. That is, specific shapes, structures, and characteristics described in the specification may be modified and implemented from one embodiment to another embodiment without departing from the spirit and scope of the present disclosure, and it should be understood that a position or arrangement of individual component may be changed without departing from the spirit and scope of the present disclosure. Therefore, the following detailed description is not intended to be construed in a limiting sense, and the scope of the present disclosure should be construed as encompassing the scope of the appended claims and all equivalents thereof.

Exemplary Embodiment of Present Disclosure

Referring to FIGS. 4 to 12, a medicine cassette 100 according to one embodiment of the present disclosure is illustrated. As illustrated in the drawings, the medicine cassette 100 according to one embodiment of the present disclosure may be configured to include a medicine supplier 200 for supplying medicines, a medicine delivery part 300 for delivering the medicines supplied from the medicine supplier 200, and a medicine discharge part 400 for discharging the medicines, which are delivered from the medicine delivery part 300, to the outside (e.g., a hopper of an automatic medicine packaging apparatus) (see FIGS. 4 and 5).

According to one embodiment of the present disclosure, the medicine supplier 200 performs a function of supplying medicines, which are accommodated in a medicine accommodation part 210, to the medicine delivery part 300 using a rotating rotor part (a rotating rotor 230 and a sliding member 240) installed at a base portion 220 of the medicine accommodation part 210.

Figure 6:
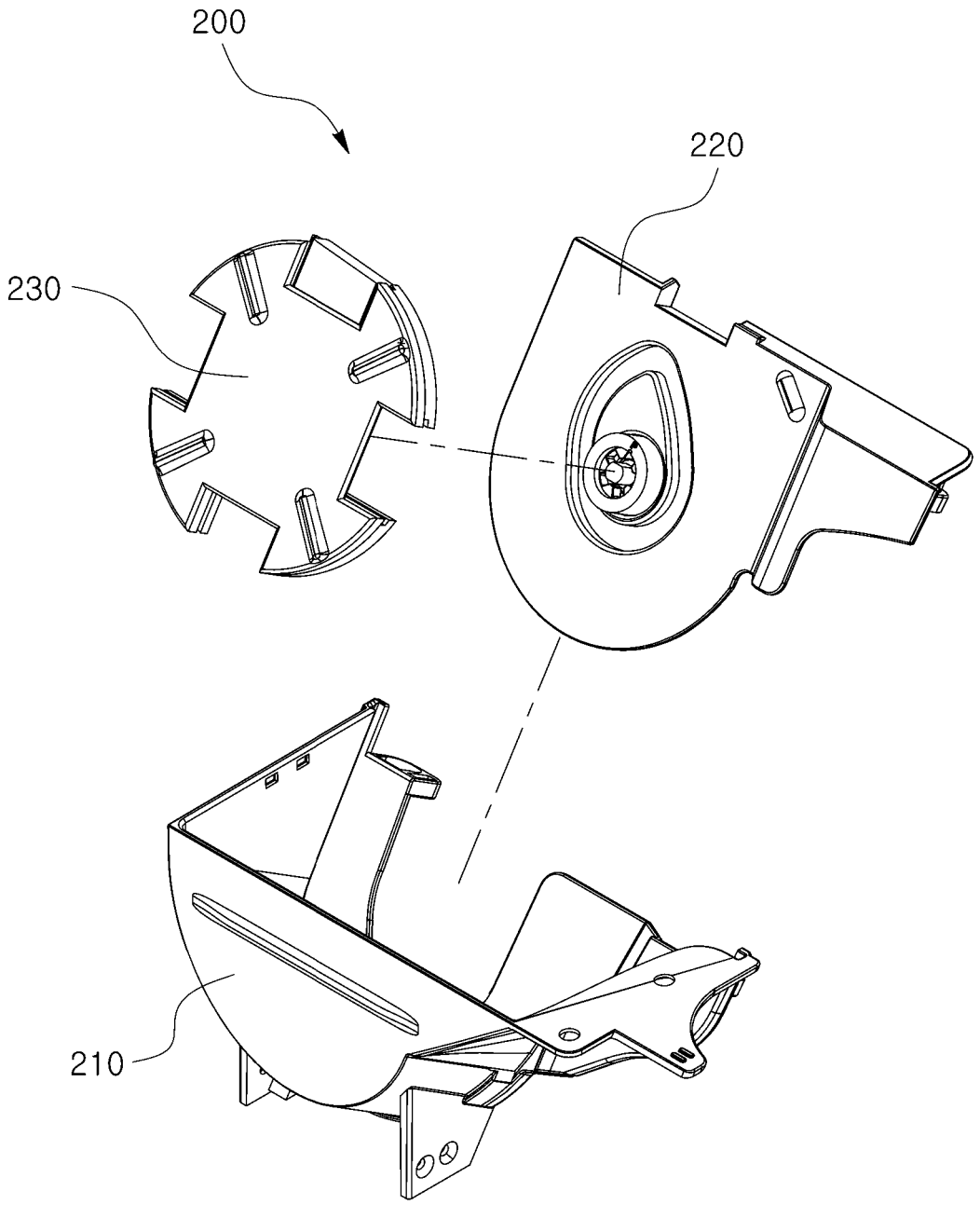
FIG. 6 exemplarily illustrates a structure of a medicine supplier in the medicine cassette shown in FIGS. 4 and 5.

In particular, the medicine supplier 200 may include the medicine accommodation part 210 in which the medicines are accommodated, the base portion 220 for forming a portion of a bottom surface of the medicine accommodation part 210, and the rotating rotor part (the rotating rotor 230 and the sliding member 240) installed at the base portion 220 (see FIG. 6). In an embodiment illustrated in the drawings, a portion of the bottom surface of the medicine accommodation part 210, at which the rotating rotor part is installed, is formed of a separate member (the base portion 220) and then the separate member (the base portion 220) is mounted to the medicine accommodation part 210, in order to facilitate an installation of the rotating rotor part. However, the base portion 220 may be integrally formed with the medicine accommodation part 210.

The medicine accommodation part 210 has an accommodation space therein to perform a function of accommodating the medicines in the accommodation space.

Figure 10:
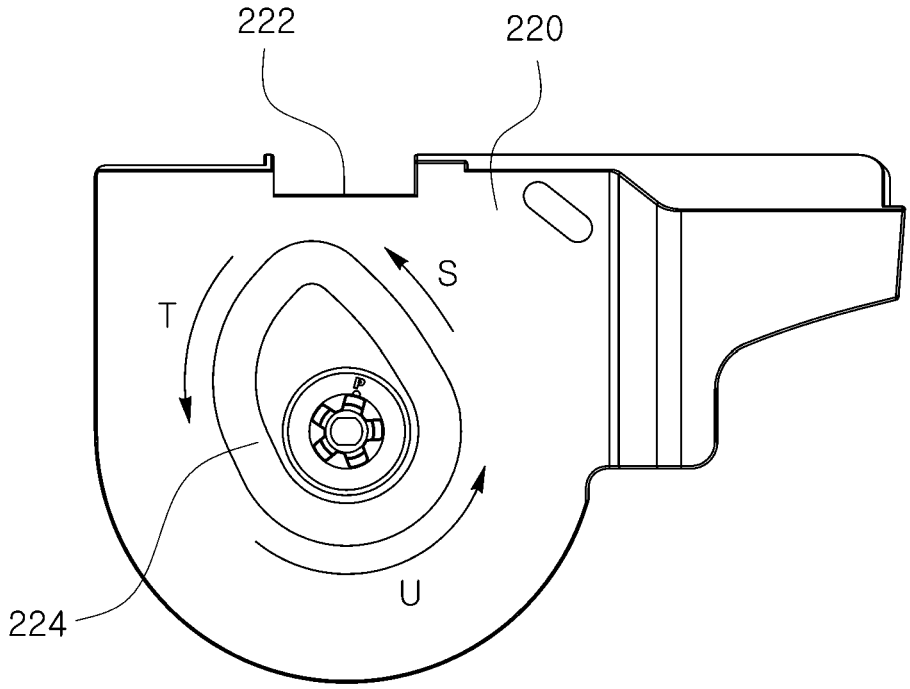
FIG. 10 exemplarily illustrates a structure of a base portion of a medicine supplier to which the rotating rotor part shown in FIGS. 7A and 7B is installed.

The base portion 220 forms the bottom surface of one side of the medicine accommodation part 210, and the rotating rotor part is installed at an upper portion of the base portion 220 to supply the medicines, which are accommodated in the medicine accommodation part 210, to the medicine delivery part 300. The base portion 220 may be disposed in an inclined structure so as to supply the medicines, which are accommodated in the medicine accommodation part 210, to the medicine delivery part 300. A medicine supply inlet 222 may be provided at one side of the base portion 220 to supply the medicines to the medicine delivery part 300. Further, according to one embodiment of the present disclosure, a guide groove 224 may be provided at an upper portion of the base portion 220 to guide a movement of the sliding member 240 installed at the rotating rotor 230, as shown in FIGS. 6 and 10. The movement of the sliding member 240 by the guide groove 224 will be described in detail below.

The rotating rotor part is installed at the upper portion of the base portion 220 to perform a function of supplying the medicines accommodated in the medicine accommodation part 210 to the medicine delivery part 300 while being rotated by a driving motor or the like.

According to one embodiment of the present disclosure, the rotating rotor 230 may be formed in a structure having a substantially disc shape and having at least one recess 232 at an outer circumference of the rotating rotor 230. In the embodiment shown in the drawing, the rotating rotor 230 has four recesses 232 at an outer circumference of the rotating rotor 230 at intervals of 90 degrees. The recesses 232 provided at the rotating rotor 230 performs a function of receiving medicines accommodated in the medicine accommodation part 210 and moving the medicines toward an upper portion where the medicine supply inlet 222 is positioned.

According to one embodiment of the present disclosure, the sliding member 240 may be installed at the recess 232 formed at the outer circumference of the rotating rotor 230 such that the sliding member is movable in the recess of the rotating rotor along the radial direction of the rotating rotor. As described below, the sliding member 240 is located at an inwardly entered position along the radial direction of the rotating rotor 230, and then the sliding member 240 is moved to an outer side in the radial direction of the rotating rotor 230 to perform a function of pushing the medicine inserted into the recess 232 to the medicine supply inlet 222 when the recess 232 approaches the medicine supply inlet 222 by a rotation of the rotating rotor 230. For example, when the recess 232 reaches a position corresponding to the medicine supply inlet 222 by a rotation of the rotating rotor 230, the sliding member 240 operates to close the recess 232 and push the medicine inserted into the recess 232 toward the medicine supply inlet 222, thereby smoothly providing the medicine to the medicine delivery part 300.

For a radial movement of the sliding member 240 relative to the rotating rotor 230, the medicine cassette 100 according to one embodiment of the present disclosure is configured such that guide slits 234 are formed at both lateral surfaces of the recess 232 of the rotating rotor 230 (see FIG. 8), and guide protrusions 242 having a shape corresponding to the guide slits 234 are formed at both lateral surfaces of the sliding member 240 (see FIGS. 9A and 9B), and the guide protrusions 242 of the sliding member 240 are slidably moved by being inserted into the guide slits 234 formed at the recess 232 of the rotating rotor 230.

Figure 4:
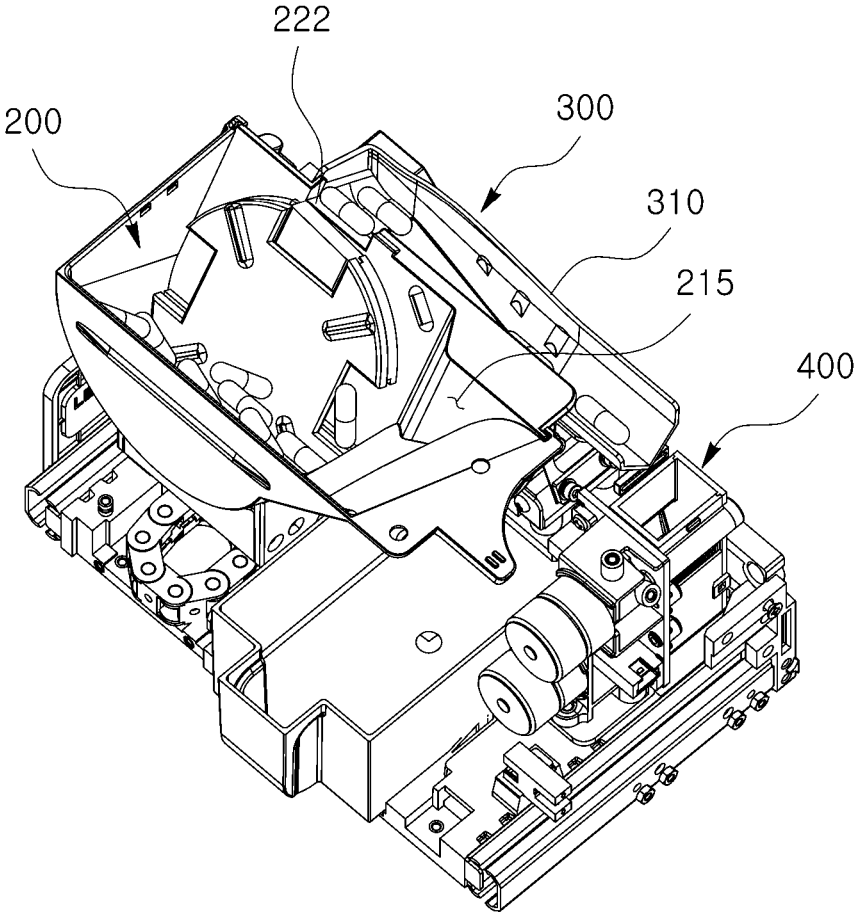
FIG. 4 exemplarily illustrates a structure of a medicine cassette according to one embodiment of the present disclosure.
Figure 5:
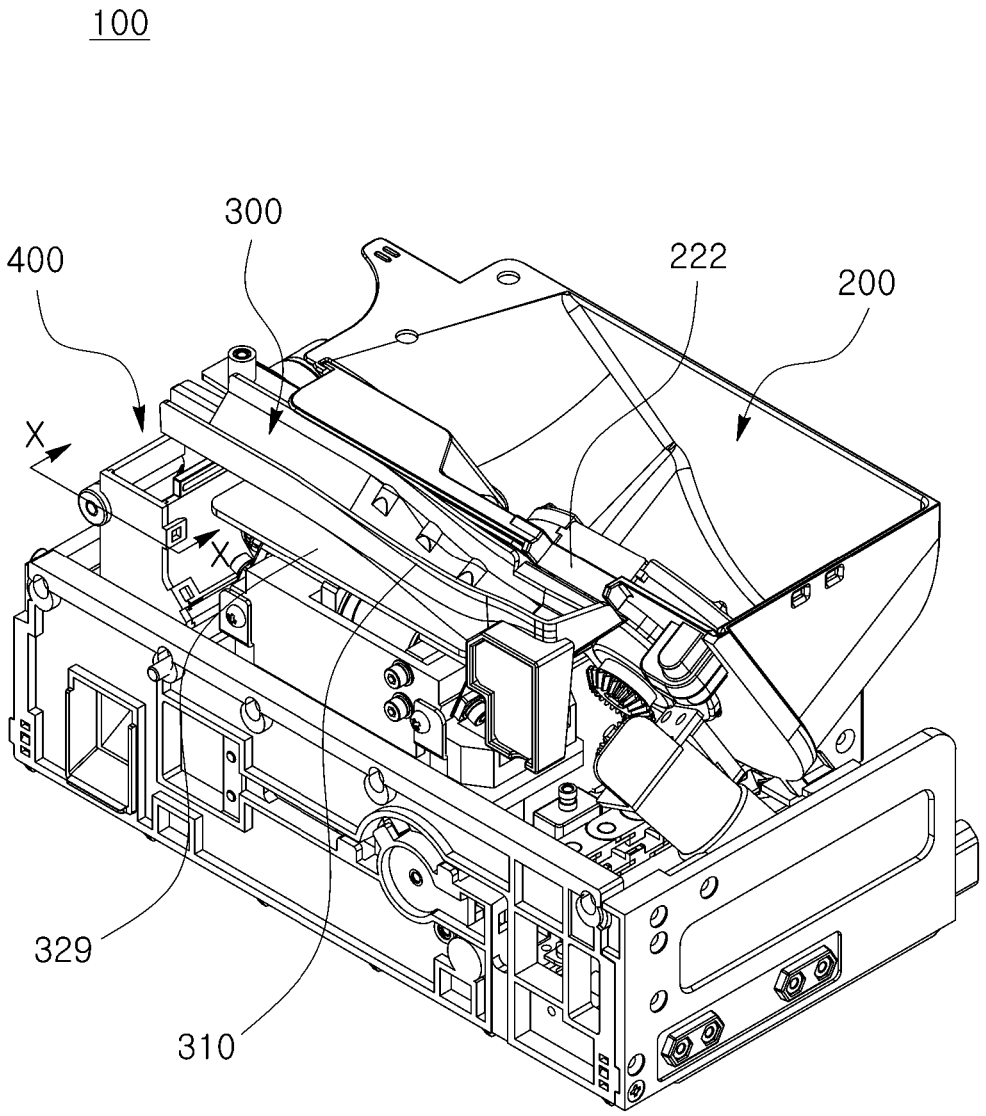
FIG. 5 exemplarily illustrates a structure of a medicine cassette according to one embodiment of the present disclosure.
Figure 7A:
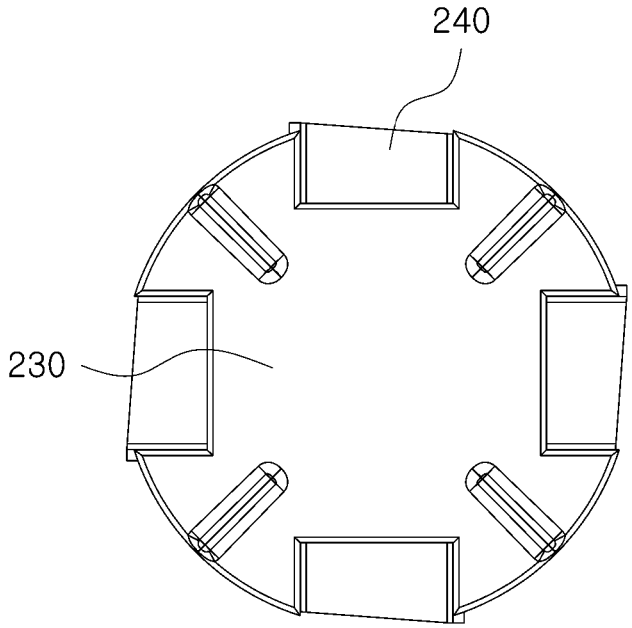
FIG. 7A exemplarily illustrates a structure of a rotating rotor part in the medicine supplier shown in FIG. 6 (All sliding members are illustrated in FIG. 7A as being moved radially outer side of the rotating rotor.).
Figure 7B:
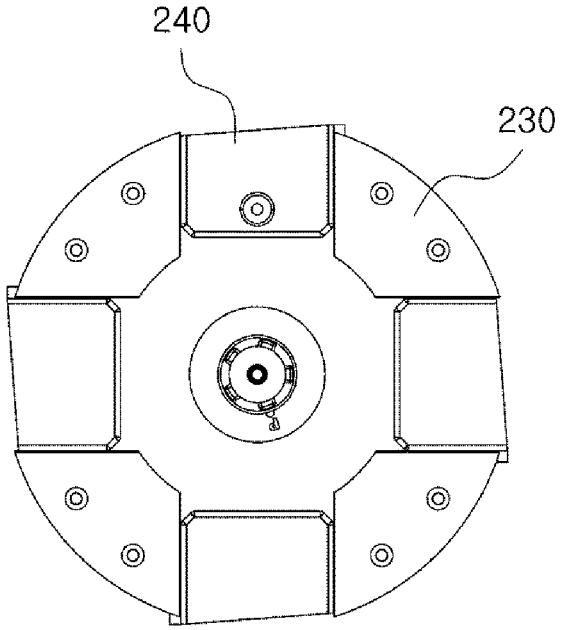
FIG. 7B exemplarily illustrates a structure of a rotating rotor part in the medicine supplier shown in FIG. 6 (All sliding members are illustrated in FIG. 7B as being moved radially outer side of the rotating rotor.).
Figure 8:
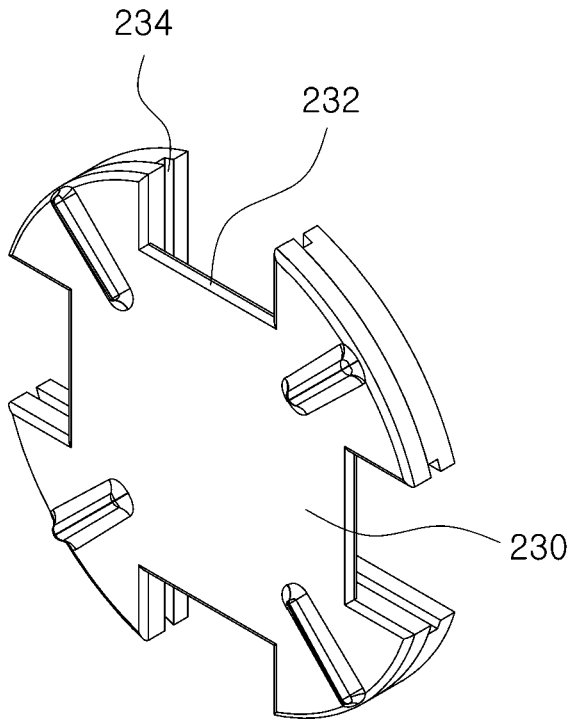
FIG. 8 exemplarily illustrates a structure of a rotating rotor in the rotating rotor part shown in FIGS. 7A and 7B.
Figure 9A:
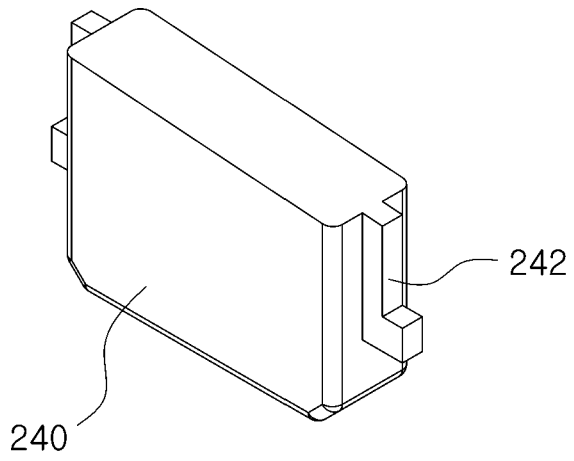
FIG. 9A exemplarily illustrates a structure of a sliding member installed to the rotating rotor shown in FIG. 8.
Figure 9B:
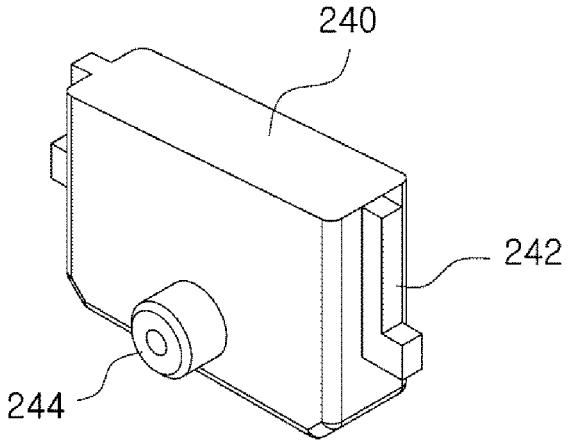
FIG. 9B exemplarily illustrates a structure of a sliding member installed to the rotating rotor shown in FIG. 8.

Meanwhile, a surface of the sliding member 240, which is positioned at the outer circumference when the sliding member 240 is installed at the rotating rotor 230, may be formed in an inclined structure (see FIGS. 4, 7A, and 7B). That is, the outer circumference of the sliding member 240 may be configured to be inclined from a front side of a rotational direction of the rotating rotor 230 toward a rear side thereof. According to such a structure, the medicine inserted into the recess 232 of the rotating rotor 230 may be more stably kept in the recess 232, and may be smoothly transferred toward the medicine delivery part 300 when the recess 232 reaches the medicine supply inlet 222.

Further, according to one embodiment of the present disclosure, a protrusion 244 vertically extending from the sliding member 240 may be provided at a rear surface of the sliding member 240. The protrusion 244 may be inserted into the guide groove 224 formed at the base portion 220 to perform a function of guiding a movement of the sliding member 240 (see FIGS. 9A, 9B, and 10).

Particularly, as shown in FIG. 10, the guide groove 224 of the base portion 220 may be formed in a shape such that the distance between the guide groove 224 and a center of rotation of the rotating rotor 230 is increased as approaching the medicine supply inlet 222 along the rotational direction of the rotating rotor 230 (i.e., as being moved in Direction S shown in FIG. 10) and the distance between the guide groove 224 and the center of rotation of the rotating rotor 230 is decreased after passing a position corresponding to the medicine supply inlet 222 (i.e., as being moved in Direction T). Meanwhile, after the sliding member 240 is inwardly moved in a radial direction of the rotating rotor 230, the distance between the guide groove 224 and the center of rotation of the rotating rotor 230 is kept in constant such that the space for receiving medicine may be secured in the recess 232 of the rotating rotor 230 (see portion U shown in FIG. 10).

According to such a structure of the guide groove 224, when the rotating rotor 230 is rotated on the base portion 220 by a driving motor or the like, the sliding member 240 may be moved in a state in which the protrusion 244 is inserted into the guide groove 224 of a base portion 220, and the sliding member 240 is outwardly moved in the radial direction of the rotating rotor 230 due to the shape of the sliding member 240 that the distance between the guide groove 224 and the center of rotation of the rotating rotor 230 is increased as approaching the medicine supply inlet 222, and the sliding member 240 is inwardly moved in the radial direction of the rotating rotor 230 due to the shape of the sliding member 240 that the distance between the guide groove 224 and the center of rotation of the rotating rotor 230 is gradually decreased after passing the medicine supply inlet 222. That is, when the recess 232 of the rotating rotor 230 into which the sliding member 240 is inserted approaches the medicine supply inlet 222, the sliding member 240 is outwardly moved in the radial direction of the rotating rotor 230 to outwardly push the medicine inserted in the recess 232 of the rotating rotor 230, thereby allowing the medicine to be smoothly transferred to the medicine delivery part 300. After the recess 232 of the rotating rotor 230 passes the medicine supply inlet 222, the sliding member 240 is inwardly moved in the radial direction of the rotating rotor 230 to make the recess 232 of the rotating rotor 230 as empty space so that the medicines accommodated in the medicine accommodation part 210 can be inserted into the recess 232 of the rotating rotor 230 and moved toward the medicine supply inlet 222.

Figure 11:
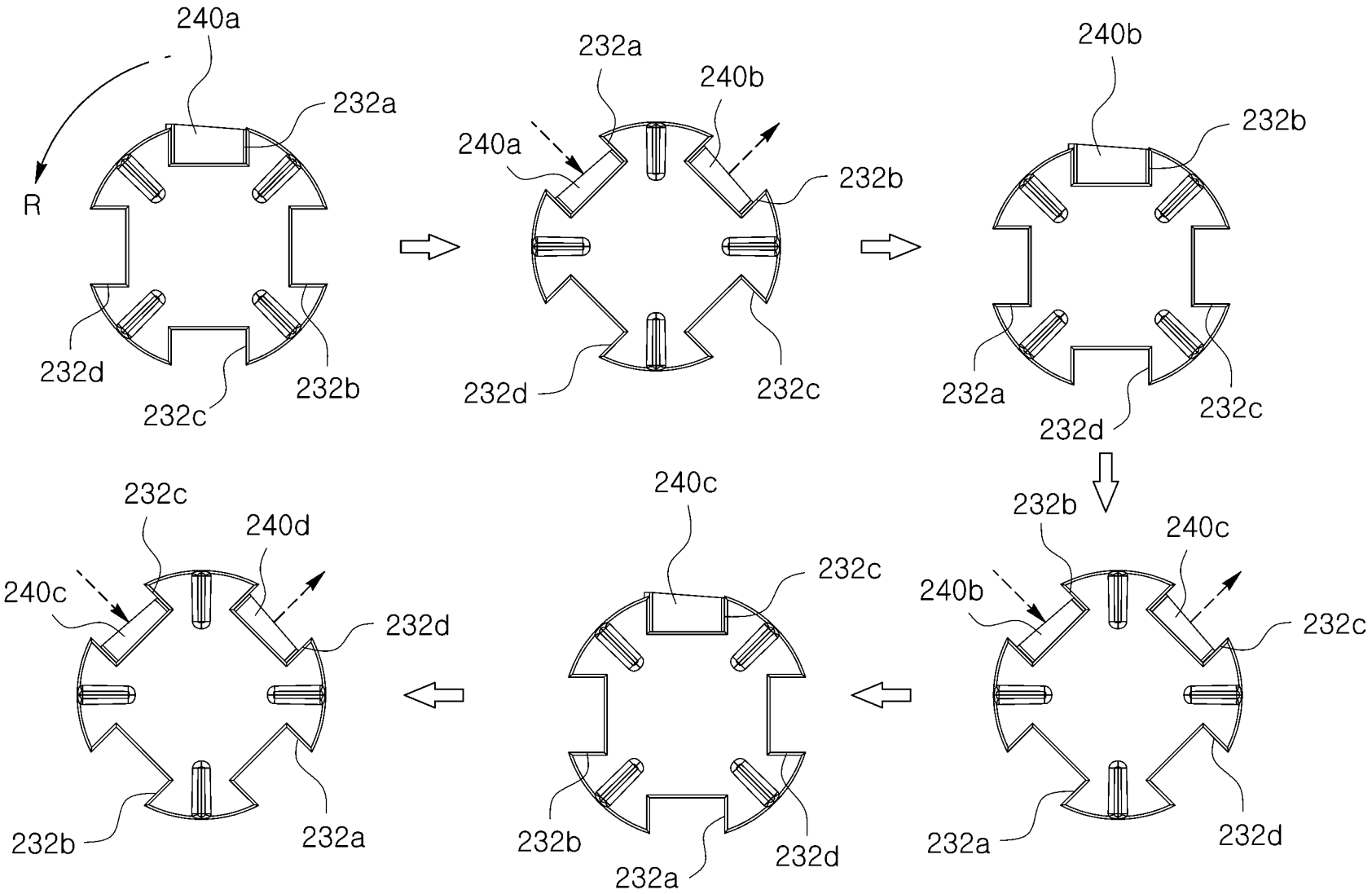
FIG. 11 exemplarily illustrates an operation of the rotating rotor part shown in FIGS. 6 to 10.

Referring to FIG. 11, operations of the rotating rotor 230 and the sliding member 240 are exemplarily illustrated. First, a first figure shown at an upper left portion of FIG. 11 illustrates a state that the recess denoted as a reference numeral 232*a* is located at the position corresponding to the medicine supply inlet 222. In such a state, when the rotating rotor 230 rotates in a counterclockwise direction (Direction R shown in FIG. 11), a sliding member 240*a* inserted in the recess 232*a* is inwardly moved in the radial direction of the rotating rotor 230 as a protrusion formed at the sliding member 240*a* is moved in the guide groove 224 formed at the base portion 220 according to Direction T, and a sliding member 240*b* inserted into a recess denoted as a reference numeral 232*b* is outwardly moved in the radial direction of the rotating rotor 230 as a protrusion formed at the sliding member 240*b* is moved in the guide groove 224 formed at the base portion 220 according to Direction S (see an upper middle diagram and an upper right diagram of FIG. 11). With such operations, the medicine inserted into the recess 232*b* is outwardly pushed from the recess 232*b* of the rotating rotor 230 by the sliding member 240*b* to be supplied to the medicine delivery part 300, and such a movement of the sliding member is repeatedly performed at all recesses as the rotating rotor 230 rotates. Accordingly, unlike the conventional medicine cassettes, the medicine may be smoothly discharged to the outside regardless of the shape of the medicine and a state that the medicine is inserted into the recess of the rotating rotor.

Meanwhile, a point of time at which the sliding member 240 starts to be inwardly moved in the radial direction of the rotating rotor 230 is preferably determined such that the sliding members 240 starts to inwardly move when the recess 232 of the rotating rotor 230 is located at a position corresponding to the medicine supply inlet 222 or immediately after the recess 232 of the rotating rotor 230 passes the position corresponding to the medicine supply inlet 222, in order to facilitate discharge of the medicine by the sliding member 240.

Further, according to one embodiment of the present disclosure, the medicine accommodation part 210 may be configured such that a space extension 215 is provided at a portion at which the recess 232 of the rotating rotor 230 is ascended toward the medicine supply inlet 222, and thus an empty space is secured at a periphery of the recess 232 which is ascended toward the medicine supply inlet 222. For example, as shown in FIG. 4, the medicine accommodation part 210 may be configured such that a wall surface of the medicine accommodation part 210 is located at a position adjacent to the recess 232 of the rotating rotor 230 which is descended toward a side opposite the medicine supply inlet 222 (i.e., toward the lower portion of the medicine accommodation part 210), whereas a wall surface of the medicine accommodation part 210 is located at a position spaced apart from the recess 232 of the rotating rotor 230 which is ascended toward the medicine supply inlet 222, and the bottom surface of the base portion 220 is formed to be downwardly stepped for securing the space extension 215 in the vicinity of the recess 232. According to such a configuration, when two or more medicines are moved while being inserted into the recess 232 of the rotating rotor 230, the medicine which is moved by being laid on an outer side of the recess 232 may be dropped again into the medicine accommodation part 210 before reaching the medicine supply inlet 222 such that it is possible to prevent a plurality of medicines from being bundled and transferred to the medicine delivery part 300.

Next, the medicine delivery part 300 performs a function of arranging medicines transferred from the medicine supplier 200 in a state of being spaced away at predetermined intervals and transferring the medicines to the medicine discharge part 400 one by one. To this end, the medicine delivery part 300 may include a transfer part 310 that the medicines are disposed on an upper portion thereof, and a vibration part 320 for applying vibration to the medicine transfer part 310 (see FIGS. 4 and 5).

The transfer part 310 is installed in a state of being finely declined toward the medicine discharge part 400 and performs a function of gradually transferring the medicines, which are disposed on the upper portion of the transfer part 310, toward the medicine discharge part 400 as the vibration part 320 vibrates. The transfer part 310 is preferably formed in a U-shaped or V-shaped cross-sectional structure such that the medicines can be disposed at a central portion of the transfer part 310 and smoothly moved. Further, the transfer part 310 may be formed of various materials such as a metal material, a non-metal material, a mixed material of the metal material and the non-metal material, and the like as necessary.

The vibration part 320 performs a function of vibrating the transfer part 310 so as to arrange the medicines disposed on the transfer part 310 one by one and allow the medicines to be moved toward the medicine discharge part 400. The vibration part 320 may have any structure as long as it can apply vibration to the transfer part 310. Since the present disclosure is not characterized in a specific structure of the vibration part 320, a detailed description of the vibration part 320 will be omitted.

Next, the medicine discharge part 400 performs a function of discharging the medicines, which are delivered by the medicine delivery part 300, to the outside (e.g., a hopper of an automatic medicine packaging apparatus). The medicine discharge part 400 may include an inlet 410 through which the medicines delivered from the medicine delivery part 300 passes, a detector (not shown) installed at the inlet 410 and configured to detect the number of the medicines delivered to the medicine discharge part, a packaging passage 420 configured to discharge the medicines to the outside (e.g., a packaging apparatus) when the number of the medicines detected through the detector matches prescription information, and a recollecting passage 430 configured to transfer the medicines to a recollecting container when the number of the medicines detected through the detector does not match the prescription information.

Figure 12:
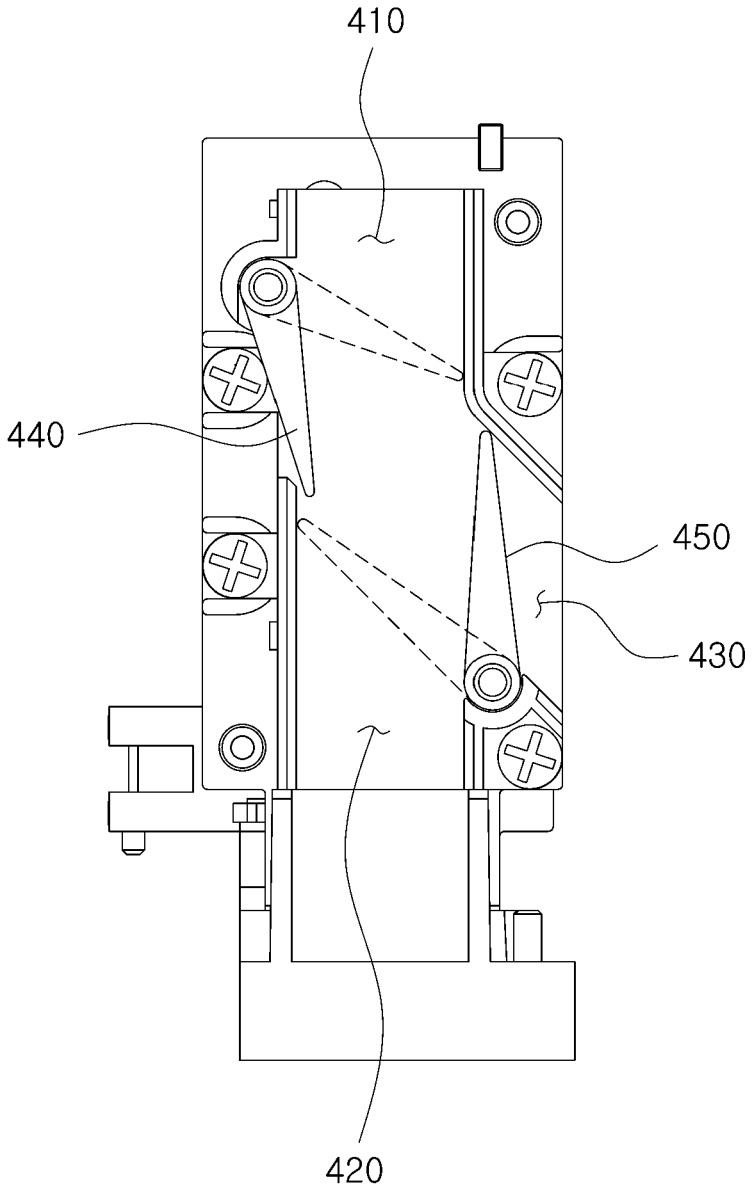
FIG. 12 exemplarily illustrates a structure of a medicine discharge part of the medicine cassette shown in FIGS. 4 and 5 (a cross sectional structure taken along the line X-X shown in FIG. 5).

According to one embodiment of the present disclosure, a retention member 440 may be provided at the medicine discharge part 400 to temporarily retain the medicines introduced through the inlet 410 at which the detector is provided, and an opening and closing member 450 may be provided at a lower portion of the retention member 440 to selectively open one of the packaging passage 420 and the recollecting passage 430 according to the detected result of the detector (see FIG. 12). The retention member 440 and the opening and closing member 450 may be installed to be pivotable in a certain angle range through a driving motor or the like.

FIG. 12 exemplarily illustrates a structure of the medicine discharge part 400 of the medicine cassette according to one embodiment of the present disclosure. In FIG. 12, the state in which the retention member 440 is pivoted in a clockwise direction such that medicines can be downwardly supplied and, at the same time, the opening and closing member 450 is pivoted in a clockwise direction to open the packaging passage 420 and close the recollecting passage 430 is illustrated as a solid line.

In this state, when the retention member 440 is rotated in a counterclockwise direction to close the inlet 410 as illustrated as a dotted line in FIG. 12, the medicines introduced into the medicine discharge part 400 may be retained on the retention member 440. Further, when the opening and closing member 450 is rotated in a counterclockwise direction as illustrated as a dotted line in FIG. 12, the packaging passage 420 may be closed and the recollecting passage 430 may be opened.

The above-described medicine discharge part 400 of the medicine cassette according to one embodiment of the present disclosure may operate as follows.

First, the number of medicines delivered to the medicine discharge part 400 is detected while passing through the detector installed at the inlet 410. At this point, the retention member 440 installed in the vicinity of the inlet 410 is rotated and located at a position capable of closing the inlet 410 to retain the medicines, which are being dropped, on the retention member 440.

When the number of the medicines dropped on the retention member 440 matches prescription information (i.e., the number of medicines which will be packaged in a single medicine pouch), the opening and closing member 450 is pivoted to a position capable of opening the packaging passage 420 and closing the recollecting passage 430. Then, when the retention member 440 is pivoted to open the inlet 410, the medicines temporarily retained on the retention member 440 may be downwardly dropped and supplied to the packaging passage 420, and the medicines supplied to the packaging passage 420 may be packaged by being fed to a packaging apparatus through a hopper of an automatic medicine packaging apparatus.

In contrast, when the number of the medicines dropped on the retention member 440 do not match the prescription information (i.e., the number of medicines which will be packed in a single medicine pouch), the opening and closing member 450 is pivoted to a position capable of opening the recollecting passage 430 and closing the packaging passage 420. Then, when the retention member 440 is pivoted to open the inlet 410, the medicines temporarily retained on the retention member 440 are downwardly dropped and supplied to the recollecting passage 430. The medicines supplied to the recollecting passage 430 are supplied to the recollecting container, and the medicines collected in the recollecting container may be reused later.

Meanwhile, the above-described medicine cassette according to one embodiment of the present disclosure may be installed at an automatic medicine packaging apparatus together with the conventional medicine cassette or instead thereof for supplying medicines. When the medicine cassette according to one embodiment of the present disclosure is installed and used in the automatic medicine packaging apparatus, medicines are automatically supplied to the packaging apparatus by a required number of the medicines according to a packaging cycle in which the medicines are discharged and packaged.

While the present disclosure has been described with reference to specific items such as particular components, exemplary embodiments, and drawings, these are merely provided to help understanding the present disclosure, and the present disclosure is not limited to these embodiments, and those skilled in the art to which the present disclosure pertains can variously alter and modify from the description of the present disclosure.

Therefore, the spirit of the present disclosure should not be limited to the above-described embodiments, and it should be construed that the appended claims as well as all equivalents or equivalent modifications of the appended claims will fall within the scope of the present disclosure.

What is claimed is:

1. A medicine cassette for automatically supplying medicines according to prescription information, the medicine cassette comprising:

a medicine supplier configured to supply accommodated medicines according to prescription information;

a medicine delivery part configured to deliver the medicines supplied from the medicine supplier to a medicine discharge part; and the medicine discharge part configured to discharge the medicines, which are delivered through the medicine delivery part, to an outside of the medicine cassette, wherein the medicine supplier includes a medicine accommodation part configured to accommodate the medicines and a rotating rotor part configured to deliver the medicines accommodated in the medicine accommodation part to the medicine delivery part;

the rotating rotor part configured to be tilted against a horizontal plane and move the medicines accommodated in the medicine accommodation part upward to the medicine delivery part by rotating around an axis tilted at a predetermined angle against the horizontal plane;

the rotating rotor part includes a rotating rotor, which is formed in a disc shape and has at least one recess formed at an outer circumference thereof, and at least one sliding member which is installed at the at least one recess of the rotating rotor such that the at least one sliding member is movable in the at least one recess of the rotating rotor along a radial direction of the rotating rotor; and the at least one sliding member is formed in a shape corresponding to a shape of the at least one recess and is operated to be outwardly moved in the radial direction of the rotating rotor and close the at least one recess as the at least one recess of the rotating rotor approaches a medicine supply inlet configured to supply the medicines to the medicine delivery part.

2. The medicine cassette of claim 1, wherein:

a protrusion vertically extending from the at least one sliding member is provided at a rear surface of the at least one sliding member;

the protrusion is inserted into and installed at a guide groove formed at a base portion of the medicine accommodation part at which the rotating rotor is installed; and the guide groove formed at the base portion is formed in a structure of guiding a movement of the at least one sliding member to be outwardly moved in the radial direction of the rotating rotor as the at least one recess of the rotating rotor approaches the medicine supply inlet.

3. The medicine cassette of claim 2, wherein the guide groove formed at the base portion is formed for guiding a movement of the at least one sliding member to be inwardly moved in the radial direction of the rotating rotor after the at least one recess of the rotating rotor passes the medicine supply inlet.

4. The medicine cassette of claim 1, wherein the at least one sliding member has a structure that a surface of the at least one sliding member, which is positioned at an outer circumference of the rotating rotor when the at least one sliding member is installed at the rotating rotor, is downwardly inclined from a front side of a rotational direction of the rotating rotor to a rear side thereof.

5. The medicine cassette of claim 1, wherein the medicine accommodation part has a space extension configured to secure empty space in a vicinity of the at least one recess which is ascended toward the medicine supply inlet.

6. The medicine cassette of claim 1, wherein:

the medicine delivery part includes a transfer part having an upper portion on which the medicines are disposed and a vibration part configured to apply vibration to the transfer part; and the medicines disposed on the transfer part are to be transferred one by one to the medicine discharge part due to vibration applied by the transfer part.

7. The medicine cassette of claim 6, wherein:

the medicine discharge part includes a detector installed at an inlet through which the medicines transferred from the medicine delivery part pass and configured to detect the number of medicines which pass the inlet, a retention member on which the medicines passing the detector is temporarily retained, and an opening and closing member installed at a downstream side of the retention member and configured to move the medicines toward a packaging passage or a recollecting passage according to a detection result of the detector; and the opening and closing member is pivotably installed between the packaging passage and the recollecting passage, and when the number of the medicines detected by the detector matches the prescription information, the opening and closing member is operated to open the packaging passage while closing the recollecting passage, whereas when the number of the medicines detected by the detector does not match the prescription information, the opening and closing member is operated to open the recollecting passage while closing the packaging passage.

8. The medicine cassette of claim 7, wherein the retention member and the opening and closing member are configured to be pivotable within a predetermined angle range by a drive motor.

9. An automatic medicine packaging apparatus comprising:

an medicine cassette for automatically supplying medicines according to prescription information, the medicine cassette comprising:

a medicine supplier configured to supply accommodated medicines according to prescription information;

a medicine delivery part configured to deliver the medicines supplied from the medicine supplier to a medicine discharge part; and the medicine discharge part configured to discharge the medicines, which are delivered through the medicine delivery part, to an outside of the medicine cassette, wherein the medicine supplier includes a medicine accommodation part configured to accommodate the medicines and a rotating rotor part configured to deliver the medicines accommodated in the medicine accommodation part to the medicine delivery part;

the rotating rotor part configured to be tilted against a horizontal plane and move the medicines accommodated in the medicine accommodation part upward to the medicine delivery part by rotating around an axis tilted at a predetermined angle against the horizontal plane;

the rotating rotor part includes a rotating rotor, which is formed in a disc shape and has at least one recess formed at an outer circumference thereof, and at least one sliding member which is installed at the at least one recess of the rotating rotor such that the at least one sliding member is movable in the at least one recess of the rotating rotor along a radial direction of the rotating rotor; and the at least one sliding member is formed in a shape corresponding to a shape of the at least one recess and is operated to be outwardly moved in the radial direction of the rotating rotor and close the at least one recess as the at least one recess of the rotating rotor approaches a medicine supply inlet configured to supply the medicines to the medicine delivery part.

* * * * *